United States Patent [19]

Schneider

[11] 4,206,751

[45] Jun. 10, 1980

[54] INTERMITTENT COMPRESSION DEVICE

[75] Inventor: John F. Schneider, Lake Elmo, Minn.

[73] Assignee: Minnesota Mining and Manufacturing Company, St. Paul, Minn.

[21] Appl. No.: 892,309

[22] Filed: Mar. 31, 1978

[51] Int. Cl.[2] ..... A61H 1/00

[52] U.S. Cl. ..... 128/24 R; 128/82.1

[58] Field of Search ..... 128/24 R, 24.1, 38–40, 128/64, 82.1, DIG. 20

[56] References Cited

U.S. PATENT DOCUMENTS

| | | | |
|---|---|---|---|
| 2,134,646 | 10/1938 | Souzedde | 128/299 |
| 2,140,898 | 12/1938 | Collens et al. | 128/64 |
| 2,747,570 | 5/1956 | Jobst | 128/39 |
| 2,781,041 | 2/1957 | Weinberg | 128/60 |
| 3,063,444 | 11/1962 | Jobst | 128/60 |
| 3,179,106 | 4/1965 | Meredith | 128/24 R |
| 3,454,010 | 7/1969 | Lilligren et al. | 128/24 R |
| 3,757,366 | 9/1973 | Sacher | 128/38 |
| 3,824,992 | 7/1974 | Nicholson | 128/24 R |
| 3,920,006 | 11/1975 | Lapidus | 128/24.1 |
| 4,013,069 | 3/1977 | Hasty | 128/24 R |
| 4,029,087 | 6/1977 | Dye et al. | 128/24 R |
| 4,030,488 | 6/1977 | Hasty | 128/24 R |
| 4,091,804 | 5/1978 | Hasty | 128/24 R |

FOREIGN PATENT DOCUMENTS

| | | | |
|---|---|---|---|
| 817521 | 7/1957 | United Kingdom | 128/64 |

*Primary Examiner*—Lawrence W. Trapp

*Attorney, Agent, or Firm*—Cruzan Alexander; Donald M. Sell; James B. Marshall, Jr.

[57] ABSTRACT

A device for applying compressive pressures to a mammal's limb from a source of pressurized fluid comprised of a first and second chamber with the first chamber being fluid impervious and the second chamber being semi-permeable for virtually continuous ventilation. The device has both a means for connecting the chambers to a source of pressurized fluid and a retaining means for positioning and directing the expansion of the chambers on to the limb to provide aid in blood circulating.

6 Claims, 4 Drawing Figures

INTERMITTENT COMPRESSION DEVICE

FIELD OF THE INVENTION

The present invention relates to pressure devices for aiding blood circulation and in particular to those for use on mammalian extremities to provide pulsating pressure so as to urge venous blood from the limb and thereby reduce undesired clotting in the extremities.

DESCRIPTION OF PRIOR ART

Immobilized patients have a tendency to develop deep vein thrombosis or thromophlebitis which is a clotting of the venous blood in the lower extremities and pelvis. The clotting usually occurs because of the absence of sufficient muscular activity in the lower legs, such activity being necessary for normal venous blood movement.

Earlier approaches have been to merely apply constant pressure to the lower limb in order to reduce the vein thrombosis. An example of this approach is the use of elastic-like stockings. This method has been considered to be somewhat effective in the reduction of thrombosis but the extent of effectiveness is lower than that of other methods.

A more modern approach has been the use of intermittent compression or intermittent positive pressure to reduce the incidence of deep vein thrombosis. Normally a cyclic pressure is delivered from a source to the patient's limb via a sleeve or what is commonly known as a compression cuff. This sleeve or cuff normally encloses a portion of the immobilized patient's limb. Some prior art sleeves have had a plurality of several fluid pressurizable chambers dispersely arranged longitudinally along the sleeve extending from the distal portion to the proximal portion of the patient's limb, e.g., U.S. Pat. No. 4,013,069. The chambers of the cuff or sleeve can either be simultaneously or sequentially filled in order to apply a compressive pressure gradient against the patient's limb which progressively changes from the distal to the proximal portion of the limb. The chambers are pressurized for a predetermined length of time then the pressure is reduced in order to enable blood to reenter the partially vacated veins.

To receive the maximum benefit from treatment utilizing a compression device of the prior art it has been found that the device should be used on the immobilized limb for long periods of time, but these prior art devices have been found to be uncomfortable when worn for the necessary period. Normally these devices have an impermeable plastic liner which contacts the skin for hours or even days to produce a clammy, sweaty, sticky and itchy skin condition and on occasion causes maceration. One prior art approach to alleviate this deficiency was to provide a limb encasing means made of a porous fabric which was used to position, in contact to the limb, one or more longitudinally extending inflatable tubes, such a device being described in U.S. Pat. No. 2,747,570. With this porous encasing means it was believed that evaporation would occur from much of the underlying skin surface, but such an approach only resulted in reducing the occluded surface that would be subject to possible maceration because the skin covered by the inflatable tubes within the encasing means was still not ventilated.

Nicholson in U.S. Pat. No. 3,824,992 describes compression devices which include an inner envelope that is sufficiently soft and compliant to mold itself to the foot and leg. The Nicholson device incorporates a plurality of holes near the toe portion of the envelope so that the fluid can be passed from the inside of the envelope to flow along the skin of the enclosed skin surface to the exit at the open end of the boot. This flow is intended to occur during the pressure portion of the cycle but when the envelope is pressurized it comes into intimate contact with the skin surface so as to block any flow that might be initiated at the toe end. Further, during the nonpressure portion of the cycle there is no fluid pressure within the envelope to force the ventilating fluid through the holes located in the toe portion. Ventilation exists, if at all, during the two very brief periods, i.e., the start of the pressure surge and near the end of the exhaust, thus resulting in long periods of skin moisture build-up.

BRIEF SUMMARY OF INVENTION

Applicant has found a device for applying compressive pressure to a mammal's limb from a source of a pressure fluid which ventilates the skin surface over which it is placed for a prolonged portion of the pressure cycle. Applicant's device comprises a compliant bladder which is comprised of a first chamber and a second chamber. The first chamber is fluid impervious and expandable when subjected to a fluid pressure. The second chamber is pressurizable and has at least one semi-permeable wall which upon exposure to a fluid pressure allows a continuous ventilating flow of fluid to pass through substantially the entire wall through to the bladder surface. The bladder is affixed to the mammalian limb with a retaining means. The retaining means positions the bladder so that the bladder's surface which is emitting the ventilating flow of the second chamber is in contact with the limb while at the same time assuring that essentially all the expansion of the first chamber is directed toward the mammalian limb causing the entire retaining means to tighten whereby the blood is forced from the limb. The device is further comprised of a means for connecting the chambers of said bladder to the source of pressurized fluid.

DESCRIPTION OF DRAWINGS

The invention may be better understood by reference to the attached drawings wherein.

DESCRIPTION OF THE PREFERRED EMBODIMENT

Figure 1:
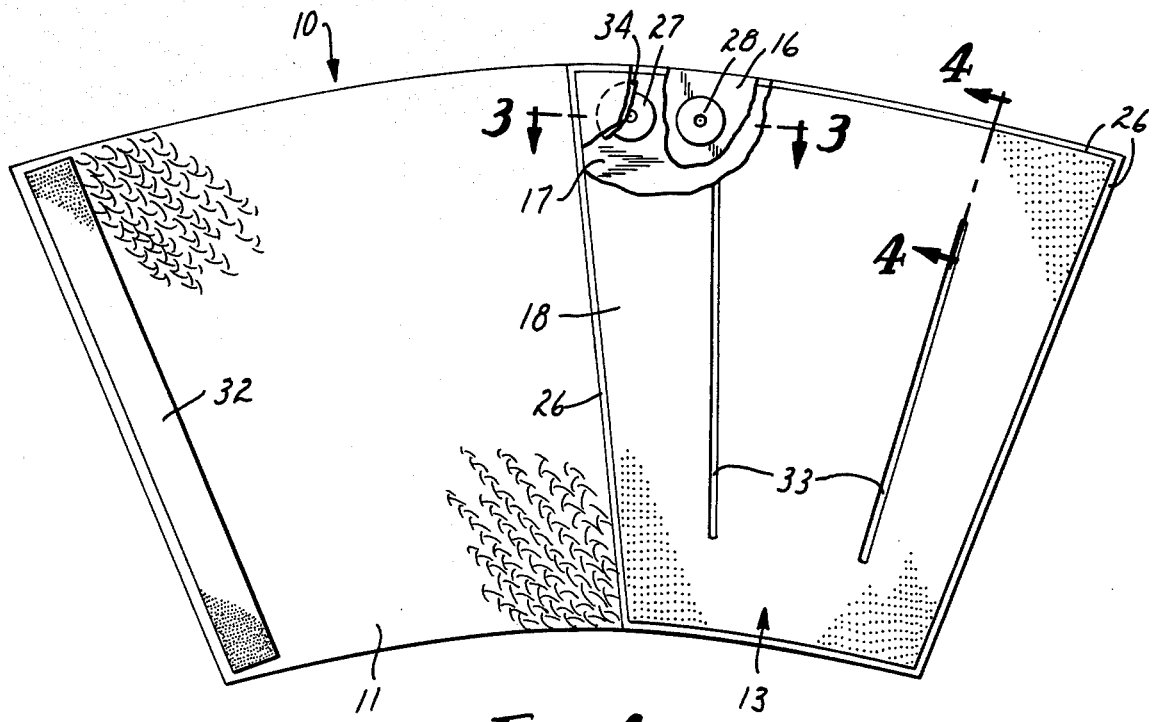
FIG. 1 is a flat view of the skin contact surface of the compression device of the present invention.
Figure 3:
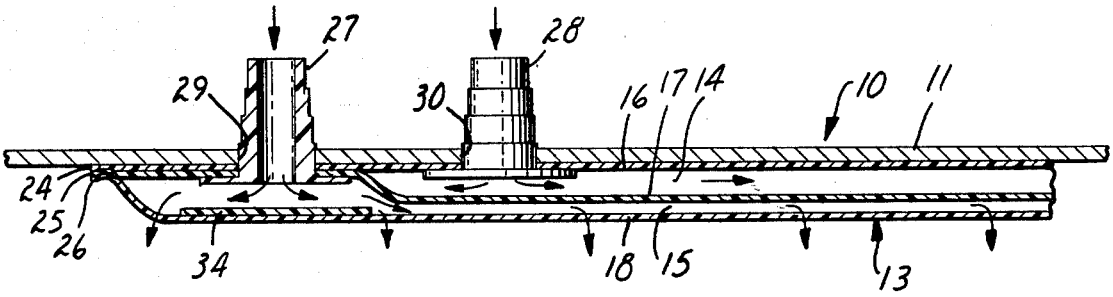
FIG. 3 is a sectional view taken along line 3—3 of the compression device of FIG. 1.
Figure 4:
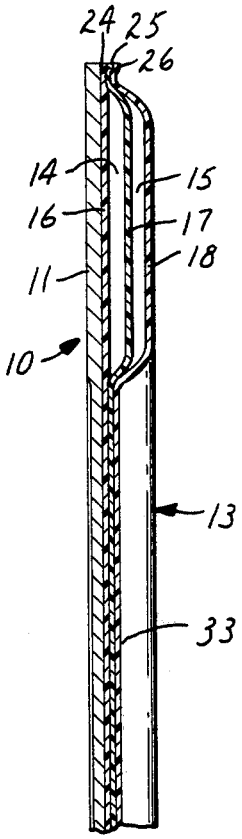
FIG. 4 is an exploded cross-sectional view to line 4—4 of FIG. 1.

Referring to FIG. 1, an intermittent compression device 10 is depicted in its flat open position. The compression device 10 utilizes a bladder 13 for the application of compressive pressures to the animal's limb. As best seen in FIG. 4, the bladder, 13, is comprised of a first chamber 14 and a second chamber 15. The first chamber 14 is fluid impervious chamber which can be one unitary chamber or can be separated into numerous smaller separated chambers. The second chamber 15 is a ventilating chamber which is pressurizable while at the same time capable of passing a ventilating flow of fluid along substantially the entire surface of a chamber wall. In the preferred form, the ventilating second chamber 15 lies between the patient's skin and the pressurizable first chamber. Referring to FIG. 3, the first chamber 14 is comprised of a first sheet 16 of compliant fluid impervious material bonded to a second sheet 17 of a compliant fluid impervious material so as to form a fluid pressurizable chamber. The preferred impervious sheet material for at least one of these sheets, when the fluid is compressed air, is ethylene vinyl acetate having a thickness of about 10 mil (0.25 mm). The other sheet can be a polyolefin, for example polyethylene. When these preferred materials are used, the bonding of the sheets may be accomplished by heat sealing the perimeter 25 of the second impervious sheet 17 to the perimeter 24 of the first sheet 16. It is contemplated that other means of bonding can be utilized such as adhesives or mechanical means. It is further contemplated that the first chamber may be constructed utilizing a tube of material wherein the ends of the tube are sealed to form the chamber.

The chambers 14 and 15 can also be divided into a number of distinct chambers in order to accommodate sequential filling if desired. These chambers are formed by thermally bonding the sheet materials 16, 17 and 18 to the chamber configuration desired and supplying these so formed chambers with the necessary ports for connection to the source or sources of fluid. Alternatively sheets 16 and 17 may be formed into numerous chambers while sheet 18 forms a single chamber extending over all the formed chambers.

As shown in FIG. 1, the bladder 13 is thermally bonded along segmentation lines 33. These segmentation lines divide the chamber into smaller interconnected compartments which tend to eliminate the movement of the bladder on the mammalian limb which results from ballooning during the expansion of the chambers.

Referring to FIG. 3, the ventilating second chamber 15 is comprised of a semi-permeable sheet material 18 bonded along its perimeter 26 to the perimeter 25 of the second impermeable sheet 17 or to the perimeter 24 of the first impervious sheet 16. The semipermeable sheet material 18 has a porous or microporous material that possesses an average porosity in the range of from about 2 to about 200 seconds, with from about 5 to about 50 being preferred, as measured by the time required for 100 ml of air under a pressure of 4.88 inches (12.4 cm) of water to pass through one (1) square inch (6.45 $cm^2$) of the material using a Gurley Desitometer Type Number 4110. The preceding test is in accordance with American Standards Test Method Number D-726 Method A. A preferred sheet material is "Tyvek" #1422A, a spun bonded high density polyethylene fiber, a trademark product of E. I. duPont de Nemours Co. of Wilmington, Delaware. Alternately, other compliant non-woven sheet materials of adequate porosity can be used. The bonding of semipermeable sheet 18 to second impermeable sheet 17 may be undertaken utilizing adhesives, mechanical locking or preferably heat sealing.

Insufficient fluid pressure in the second chamber 15 causes inadequate ventilation while excess fluid pressure causes a possible unwanted restriction on blood circulation. The workable range of pressure for the second chamber 15 of the present invention is normally from about 1 mm of Hg to about 15 mm of Hg with a range of about 2 to about 10 mm of Hg being preferred, and 5 mm of Hg most preferred.

As seen in FIG. 3, the first chamber 14 and the second chamber 15 contain means for connection to a source of pressurized fluid. The means for connection of the present invention are port valves 27 and 28 which are generally commercially available. The valves chosen for use herein are made of ethylene vinyl acetate in order to aid in the formation of an air tight bond to the impervious sheets. Port valve 28 provides for the delivery of pressurizable fluid to the first chamber 14. Valve 28 is bonded to sheet 16 in an air tight seal. Valve 27 passes through sheet 16 and is bonded in an air tight seal to second sheet 17 so as to allow passage of ventilating fluid into the second chamber 15. An air deflector 34 is positioned opposite valve 27 so that the fluid entering the chamber does not immediately pass through the semi-permeable sheet 18 but is distributed throughout the entire second chamber. The air deflector 34 is an impervious material, e.g., a vinyl tape disc.

Still referring to FIG. 3, the bladder assembly 13, comprised of chambers 14 and 15, is bonded along its perimeter, preferably by heat sealing, to a retaining means represented here as a backing sheet 11. The backing sheet 11 is provided with holes 29 and 30 for the passage of ports 27 and 28 and bladder 13 is orientated so that the ventilating chamber's surface is positioned to contact the skin surface. The backing sheet 11 is preferably comprised of a porous nonelastic material in order that the natural breathing of the skin of that portion of the limb not covered by the bladder but which is encased by the backing sheet can continue. The expansion of the first chamber 14 is distributed around the entire limb which the device encases so that the blood is forced from the limb. The material preferred for the backing sheet in the present invention is Tempo Iron Velvet, a commercially available product of Guilfurd House Mills, Greensboro, N.C. Tempo Iron Velvet is comprised of a laminate of polyester polyurethane foam sandwiched between a Nylon Loop surface fabric and a cellulose acetate jersey backing.

As shown in FIG. 1, the backing sheet 11 is affixed a closure strip of the type described in U.S. Pat. No. 3,009,235. The closure strip 32 used in conjunction with outer surface of the backing sheet 11 combine to form a simple, multi-adjustable and effective retaining means for ensuring a permanent positioning of the cuff on the mammal's limb.

Alternately, the bladder may be retained in position without the use of the backing sheet 11. This can be accomplished, for example, by extending the semipermeable sheet material 18 beyond the bladder so as to function as the backing or extending the first or second sheet to serve the function of the backing sheet.

Figure 2:
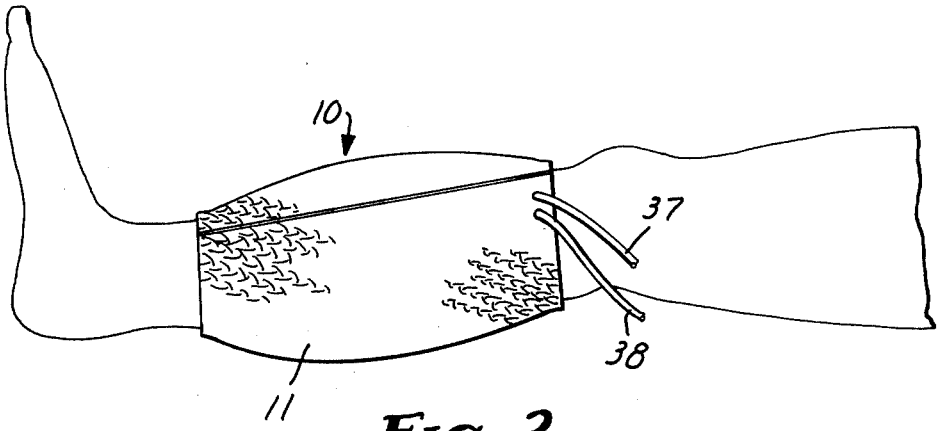
FIG. 2 is a side elevation of the compression device of the present invention applied to a person's limb.

Referring to FIG. 2, a normally flat completed assembly is placed on the animal's limb and connected to a source of ventilating fluid 37 and a source of cyclic pressurized fluid 38. The sources of fluid may be the same or may be independent. The second chamber can be pressurized simultaneously with the first chamber. Pressure of the first chamber will provide intimate contact between the ventilating surface and the skin during the pressure cycle, however, the ventilating second chamber serves as a cushion beneath seams of a compartmentized pressure chamber, thereby reducing or eliminating skin discomfort due to such inflexible seams which may result from the bonding process while at the same time allowing the natural breathing of the encased skin surface to continue. Some or all of the fluid admitted to the ventilating chamber during the pressure portion of the cycle may be admitted directly from the pressure chamber or chambers possibly through sized orifices or check valves between chambers. A possible usage of this method does involve calibrated leakage from the upper of divided pressure chambers to the ventilation chamber, such calibrated leakage serving to provide for graduated pressure differential in the pressure chambers.

Upon exhaust of pressure from the first chamber, the ventilation chamber can accordingly expand outward and simultaneously reduce in pressure and initiate skin ventilation. It is intended that skin ventilation will occur also during the non-pressure portion of the cycle. The ventilation chamber contains fluid during this portion of the cycle but at a low pressure so that little or no pressure is applied against the limb. In the preferred form of the invention, fluid will be supplied to the ventilation chamber at a low rate during this non-pressure portion of the cycle, with the fluid being supplied directly from the fluid supply source.

What is claimed is:

1. A device adapted to contact the skin surface of the mammalian limb and to apply compressive pressures to the mammalian limb from a source of pressurized fluid comprising:

(a) a compliant bladder having a skin contacting surface, said bladder being comprised of a first wall, a second wall and a semipermeable third wall being positionable adjacent the skin, said first wall being spaced with respect to the skin parallel to said third wall with said second wall interposed between and affixed to said first and third walls so that said first and second walls form a first chamber and said second and third walls form a second chamber which extends over substantially the entire surface of said second wall, said first chamber being fluid impervious and expandable when subjected to a fluid pressure, said second chamber being pressurizable whereby upon pressurization said third wall allows a nearly continuous ventilating flow of fluid to be passed through substantially the entire third wall through to said skin surface;

(b) a means for connecting the first chamber and the second chamber of said bladder to the source of pressurized fluid;

(c) a retaining means for affixing said bladder to the mammalian limb such that said third wall emitting the ventilating flow from said second chamber is in contact with the limb and expansion of said first chamber, resulting from pressure of the fluid within said first chamber, is essentially directed to the mammalian limb, whereby the retaining means and said bladder tightens around the encased mammalian limb.

2. The device for applying compressive pressures to a mammalian limb of claim 1 wherein the semi-permeable wall of said second chamber has an average porosity in the range of about 2 to about 200 seconds.

3. The device for applying compressive pressures to a mammalian limb of claim 1 wherein the semi-permeable wall of said second chamber is a conformable sheet of spun bonded high density polyethylene fiber having an average porosity in the range of about 5 to about 50 seconds.

4. The device for applying compressive pressures to a mammalian limb of claim 1 wherein said first chamber is composed of ethylene vinyl acetate.

5. A device for applying compressive pressures to a mammalian limb from a source of pressurized fluid comprising:

(a) a compliant bladder having a skin contacting surface, said bladder being comprised of at least one ventilating chamber adjacent said skin contacting surface and a multiplicity of fluid impervious chambers, said fluid impervious chambers being expandable when subjected to a fluid pressure, said ventilating chamber being pressurizable and overlaying substantially all of said fluid impervious chambers and having at least one semi-permeable wall whereby upon exposure to a fluid pressure a ventilating flow of fluid is possible through substantially the entire semi-permeable wall of said ventilating chamber to the skin contacting surface of said bladder;

(b) means for connecting said chambers of said bladder to the source of pressurized fluid;

(c) a retaining means for affixing the bladder to the mammalian limb such that said skin contacting surface emitting the ventilating flow is in contact with the limb and said chambers expansion, which results from pressure of the fluid within said chambers, is essentially directed to the mammalian limb whereby the retaining means and said bladder tightens around the encased limb.

6. The device for applying compressive pressures to a mammalian limb of claim 5 wherein the semi-permeable wall of said second chamber is a conformable sheet of spun bonded high density polyethylene fiber having an average porosity in the range of about 5 to about 50 seconds and forming a chamber pressurizable from about 2 to about 10 mm of Hg.

* * * * *